US009217569B2

(12) United States Patent
Prade

(10) Patent No.: US 9,217,569 B2
(45) Date of Patent: Dec. 22, 2015

(54) BURNER AND METHOD FOR OPERATING A BURNER

(75) Inventor: Bernd Prade, Mülheim (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1082 days.

(21) Appl. No.: 13/121,955

(22) PCT Filed: Sep. 14, 2009

(86) PCT No.: PCT/EP2009/061846

§ 371 (c)(1),
(2), (4) Date: Mar. 31, 2011

(87) PCT Pub. No.: WO2010/037627

PCT Pub. Date: Apr. 8, 2010

(65) Prior Publication Data

US 2011/0179797 A1 Jul. 28, 2011

(30) Foreign Application Priority Data

Oct. 1, 2008 (EP) ..... 08017321

(51) Int. Cl.

| | |
|---|---|
| ***F02C 3/20*** | (2006.01) |
| ***F23R 3/14*** | (2006.01) |
| ***F23R 3/26*** | (2006.01) |
| ***F23R 3/36*** | (2006.01) |

(52) U.S. Cl.

CPC ... *F23R 3/14* (2013.01); *F23R 3/26* (2013.01); *F23R 3/36* (2013.01); *F23R 2900/00002* (2013.01)

(58) Field of Classification Search

None

See application file for complete search history.

(56) References Cited

U.S. PATENT DOCUMENTS

| | | | | | |
|---|---|---|---|---|---|
| 941,833 | A | * | 11/1909 | Williams | 431/187 |
| 1,860,987 | A | * | 5/1932 | Braine et al. | 431/183 |
| 1,922,857 | A | * | 8/1933 | Meachem | 431/178 |
| 2,579,049 | A | | 12/1951 | Price | |
| 3,490,230 | A | * | 1/1970 | Suter et al. | 60/39.23 |

(Continued)

FOREIGN PATENT DOCUMENTS

| | | | |
|---|---|---|---|
| RU | 2009350 | C1 | 3/1994 |
| RU | 2156405 | C2 | 9/2000 |

(Continued)

OTHER PUBLICATIONS

Harry Morehead, "Seimens Global Gasification and IGCC Update," presented at APPA New Generation Workshop Jan. 11, 2007, see pp. 17, 21, 22 and 24.*

*Primary Examiner* — Gregory Huson
*Assistant Examiner* — Martha Becton

(57) ABSTRACT

A burner and a method for operating a burner are provided. The burner includes a channel having a mixing zone and having a feed for an oxidation means, particularly an air feed, and at least one fuel feed for injecting fuel, wherein a separating means which divides the channel over a wide range of the channel into at least two separated channels, namely a first channel and a second channel, is provided in the channel. The method for operating a burner having a channel includes a mixing zone into which an oxidation mass flow and fuel are injected, wherein two substantially separate flow paths are formed by means of a separating means in the channel and the at least two separated first and second channels, formed by the separating means.

19 Claims, 1 Drawing Sheet

(56) References Cited

U.S. PATENT DOCUMENTS

| | | | | | |
|---|---|---|---|---|---|
| 3,811,277 | A * | 5/1974 | Markowski | 60/733 | |
| 3,838,652 | A * | 10/1974 | Schol | 431/116 | |
| 4,070,826 | A * | 1/1978 | Stenger et al. | 60/748 | |
| 4,089,638 | A * | 5/1978 | Trucco et al. | 431/209 | |
| 4,333,405 | A * | 6/1982 | Michelfelder et al. | 110/264 | |
| 4,412,810 | A * | 11/1983 | Izuha et al. | 431/186 | |
| 4,534,166 | A | 8/1985 | Kelm et al. | | |
| 4,614,159 | A * | 9/1986 | Sugiura et al. | 110/261 | |
| 4,701,124 | A * | 10/1987 | Maghon et al. | 431/284 | |
| 4,838,783 | A * | 6/1989 | Fuglistaller et al. | 431/284 | |
| 5,062,792 | A * | 11/1991 | Maghon | 431/284 | |
| 5,359,847 | A * | 11/1994 | Pillsbury et al. | 60/39.463 | |
| 5,373,693 | A * | 12/1994 | Zarzalis et al. | 60/39.23 | |
| 5,451,160 | A * | 9/1995 | Becker | 431/284 | |
| 6,038,864 | A * | 3/2000 | Prade et al. | 60/748 | |
| 6,148,603 | A * | 11/2000 | Althaus | F23R 3/28 | 60/39.465 |
| 6,196,142 | B1 * | 3/2001 | Ohlsen | F23C 7/004 | 110/261 |
| 6,632,084 | B2 * | 10/2003 | Berenbrink | F23D 17/002 | 431/284 |
| 7,553,153 | B2 * | 6/2009 | Okazaki et al. | 431/187 | |
| 7,566,217 | B2 * | 7/2009 | Morsner | 431/12 | |
| 8,104,285 | B2 * | 1/2012 | Bonzani | F23D 17/002 | 239/399 |
| 8,177,547 | B2 * | 5/2012 | Kostlin et al. | 431/284 | |
| 8,215,950 | B2 * | 7/2012 | Singh et al. | 431/187 | |
| 8,393,893 | B2 * | 3/2013 | Schroder et al. | 431/182 | |
| 2001/0018173 | A1 * | 8/2001 | Tiemann | 431/284 | |
| 2006/0005542 | A1 * | 1/2006 | Campbell et al. | 60/723 | |
| 2006/0035188 | A1 * | 2/2006 | Berenbrink et al. | 431/285 | |
| 2007/0092847 | A1 * | 4/2007 | Okazaki et al. | 431/187 | |
| 2007/0275337 | A1 | 11/2007 | Heilos et al. | | |
| 2010/0293956 | A1 * | 11/2010 | Nadkarni | 60/748 | |
| 2013/0074506 | A1 * | 3/2013 | Kock et al. | 60/746 | |
| 2013/0174558 | A1 * | 7/2013 | Stryapunin | 60/734 | |

FOREIGN PATENT DOCUMENTS

| | | | |
|---|---|---|---|
| SU | 334436 | | 3/1972 |
| WO | WO2005080878 | A1 * | 9/2005 |
| WO | WO 2009121779 | A1 | 10/2009 |

* cited by examiner

BURNER AND METHOD FOR OPERATING A BURNER

CROSS REFERENCE TO RELATED APPLICATIONS

This application is the US National Stage of International Application No. PCT/EP2009/061846, filed Sep. 14, 2009 and claims the benefit thereof. The International Application claims the benefits of European Patent Office application No. 08017321.4 EP filed Oct. 1, 2008. All of the applications are incorporated by reference herein in their entirety.

FIELD OF INVENTION

The invention relates to a burner comprising a channel with a mixing zone and with an oxidation means supply, especially air supply, and at least one fuel supply for injection of fuel. The invention also relates to a method for operating such a burner.

BACKGROUND OF INVENTION

Dry natural gas premixing combustion is used for low-pollutant natural gas combustion. Premixing burners typically comprise a premixing zone in which air and fuel are mixed before the mixture is directed into a combustion chamber. The mixture burns in said chamber, with a hot gas being generated at increased pressure. The hot gas is transferred to the turbine. Premixing is of particular advantage in respect of nitrous oxide emissions since an even flame temperature obtains as a result of the homogeneous mixture. Nitrous oxide formation increases exponentially with the flame temperature. The primary consideration when operating premixing burners is thus to keep nitrous oxide emissions low and to avoid uncontrolled combustion, e.g. a flame blowback.

Syngas burners are characterized by the use of syngases as fuel in them. Compared to the classical turbine fuels of natural gas and oil, which essentially consist of hydrocarbons, the combustible elements of the syngases are essentially carbon monoxide and hydrogen. Depending on the gasification method and the overall plant concept, the heating value of the synthetic gas is around 5 to 10 times smaller than that of natural gas.

As well as the stoichiometric combustion temperature of the syngas the mixture quality between syngas and air at the flame front is a significant influencing variable for avoiding temperature peaks and thereby for minimizing thermal nitrous oxide formation.

The main elements of the syngases, in addition to carbon monoxide and hydrogen, are also inert components. The inert components involved are nitrogen and/or water vapor and where necessary also carbon dioxide. As a consequence of the low heating value, high volume flows of combustion gas must accordingly be introduced into the combustion chamber.

Current syngas combustion chambers are embodied as diffusion combustion chambers because of their high reactivity. Steam or nitrogen is usually used as a thinning agent in order to reduce thermal NOx formation. The use of steam/nitrogen as a thinning means in syngas combustion reduces the maximum level of efficiency of the overall system.

All previous syngas burners require the addition or mixing-in of an inerting medium (steam) to reduce the peak temperatures and thereby the NOx emissions. Because of the underlying design of the syngas burner with syngas as primary fuel however very large quantities of inerting medium would be necessary, making operating with natural gas economically unattractive, e.g. if the concept of diffusion combustion with addition of an inerting medium is also used in natural gas operation.

SUMMARY OF INVENTION

The object of the present invention is thus to specify a burner which is able to be operated both with combustible natural gas, especially natural gas and also with syngas and overcomes the disadvantages given above. A further object is to specify a method for operating such a burner.

The first object is achieved by a burner as claimed in the claims. The object related to the method is achieved by the specification of a method as claimed in the claims. The dependent claims contain further advantageous embodiments of the invention.

The inventive burner comprises a channel with a mixing zone, especially a premixing zone and with an oxidation means supply, especially an air supply and at least one fuel supply for dosing of fuel, with a separation means being provided in the channel which divides the channel over a wide area of the channel into at least two separate channels, namely a first channel and a second channel.

According to the invention the single channel is thus divided into at least two channels, namely a first and also a second channel. In this case each of these channels produced has a smaller volume than the overall channel. The additional second channel now produced by the separation means, preferably the smaller channel in terms of volume, can be supplied in such case in accordance with the operating mode. For injection of syngas into this second channel, the oxidation means, i.e. the air in this case in this second channel is largely expelled. Expulsion is possible since the second channel involved is an open channel so to speak. This air then flows through the separate first channel. The result is a diffusive syngas operation as far as possible. The syngas or the syngas oxidation means mixture in the second channel emerges into the first channel at the same speed as the oxidization means. This avoids undesired shearings. Furthermore the second channel and also the first channel can have an oxidization means, preferably air, applied to them. In addition natural gas can subsequently be injected into both channels, which is premixed in the premixing zone. This corresponds to a conventional operation with natural gas and premixing.

It is thus made possible by means of the invention for a burner to be operated with syngas and also with natural gas.

The invention further makes it possible for the syngas operation to largely correspond to diffusion operation, while natural gas operation largely corresponds to a premixing principle. This makes operation of a syngas burner operation with natural gas economically attractive for example.

Preferably a central axis is provided with the means of separation being concentric to the central axis. In a preferred embodiment the separation means is essentially arranged on one of the flow lines. This means that in terms of flow no uncontrollable turbulences arise. In addition this type of realization only corresponds to a slight modification compared to conventional standard burners, which is once again of major economic benefit.

Preferably the separation means is made of metal or a metal alloy, especially a sheet metal. This is especially simple and low-cost to realize and in addition has the necessary resistance to high temperatures.

In a preferred embodiment one or more inlet openings are provided for fuel, especially syngas. These can be made in the premixing channel on the side of the channel facing towards the central axis. Furthermore a swirl generator with swirler blades, especially an air swirl generator, is preferably provided. In this case the single inlet opening or the number of inlet openings for fuel are arranged upstream of the swirler blades in the main direction of flow. This type of arrangement produces an open second channel.

Preferably at least one fuel nozzle is provided and the fuel, especially natural gas, can be injected through the at least one fuel nozzle into an oxidation means mass flow, especially air swirled by the swirl generator, especially air swirl generator, in the mixing zone. Preferably in this case the at least one fuel nozzle is arranged in one or more rows lying behind one another downstream of the swirl generator, especially the air swirl generator. In this case the swirl generator can have swirl blades for improved swirling of the oxidation means, especially the air. An arrangement of the at least one fuel nozzle on these swirler blades is especially advantageous since a good mixing of the injected fuel with the oxidation means is produced.

Preferably the second channel is smaller than the first channel in respect of its volume. If syngas flows into this second channel during syngas operation, as a result of the selected volume the oxidation means, meaning the air, is largely expelled. However the remaining first channel also has a reduced volume in relation to the original undivided channel. This is however of particular advantage in relation to the requirements of a syngas machine. To generate the syngas, depending on the concept, air is namely removed at the compressor end of the gas turbine and is split into its main components of oxygen and nitrogen. The oxygen is subsequently used for syngas generation. Because of the air removal less air is finally available.

The inventive method of operating a burner with the channel comprises a mixing zone, especially a premixing zone, into which an oxidation mass flow and fuel are injected, whereby by means of a separation means in the channel and the at least two separate first and second channels formed as a result, two substantially separate flow paths are embodied. The flows are opened in relation to one another. In this case the one flow path now additionally produced can be used in accordance with the operating mode; in this case the additional flow path which carries the smaller flow is preferably used as a syngas flow path. As a result of this arrangement the oxidation mass flow is then forced into this part of the premixing path and flows on the second flow path to the combustion chamber. Both flows exit from the premixing zone with the same speed profile so that undesired shearings do not occur. This corresponds to conventional syngas operation. The effect of the paths opened in relation to one another is that, during operation with other fuels, primarily natural gas in this case, a conventional natural gas operation is established, meaning that both flow paths guide a fuel/oxidation means to the combustion chamber. The additional flow path, either as a syngas flow path or as a natural gas flow path, now advantageously has the same aerodynamics as a conventional natural gas premixing burner.

In a preferred embodiment the mixing zone, especially the premixing zone of the method, comprises a cone side and a hub side and/or a swirl generator, especially a hollow air swirl generator. The fuel, especially natural gas is injected on the cone side and/or the hub side and/or via the swirl generator, especially the air swirl generator into the mixing zone, especially into the premixing zone.

Preferably the fuel is injected via the least one swirler blade of the swirl generator, especially air swirl generator, into the mixing zone, especially premixing zone. In a preferred embodiment the fuel, especially syngas, is supplied by one or more inlet openings. These inlet openings can for example be arranged in the channel on the hub side in front of the swirler blades.

BRIEF DESCRIPTION OF THE DRAWINGS

Further features, characteristics and advantages of the present invention will be explained below on the basis of an exemplary embodiment which refers to the enclosed figures.

The figures show

DETAILED DESCRIPTION

Figure 1:
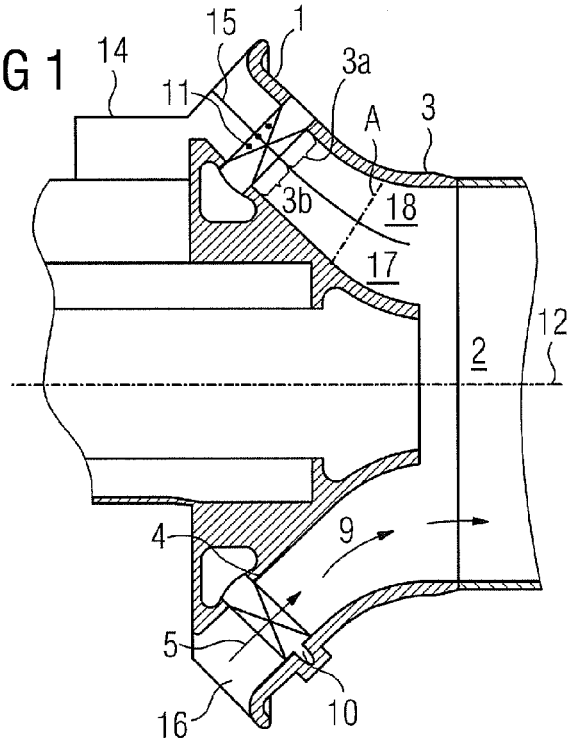
FIG. 1 a section through a part of the inventive burner.

The invention will be explained below in greater detail with reference to FIG. 1. FIG. 1 shows a schematic diagram of a section through a part of a burner with a channel 1. The channel 1 includes a mixing zone 2, a swirl generator 10, here embodied as an air swirl generator 10, and one or more fuel nozzles 11. The mixing zone 2 is arranged radial-symmetrically around the central axis 12. The outer side of the zone 2 seen from the central axis 12 is referred to below as the cone side 3. The side of the premixing zone 2 facing towards the central axis 12 is referred to below as the hub side 4.

An oxidation means mass flow, especially an air mass flow 5, reaches the air swirl generator 10 via a supply, especially air supply 16; the direction of flow of the supplied air mass flow is indicated by arrows 5. This flow can also involve an air/fuel mixture already enriched. The air swirl generator 10 swirls the air mass flow 5 and forwards this into the zone 2. From there the air mass flow 5 is forwarded in the main direction of flow 9 to the combustion chamber (not shown).

On the hub side 4 of the mixing zone 2 are one or more fuel nozzles 11. Fuel, especially natural gas, is conveyed either at right angles or also at any other given angle to the main direction of flow 9 of the air mass flow 5 through the fuel nozzles 11 into the premixing zone 2. Basically the fuel nozzles 11 can be located both on the cone side 3 and also on the hub side 4 of the premixing zone 2 also in the swirler blades 10.

In addition the inventive burner 100 comprises one or more inlet openings 14 (only shown in the upper part of the burner 100) for a gaseous fuel, here preferably syngas, which are preferably located upstream of the swirler blades 10 in the main direction of flow 9.

Provided concentric to the central axis 12 in the burner 100 in channel 1 is a separation means 15 (only shown in the upper part of the burner 100), which divides the channel 1 over a wide area of the channel 1 into at least two separate channels 3*a* and 3*b*. In this case the separation means 15 is preferably embodied as a metal sheet. In this case the separating means 15 is embodied so that the hub-side channel 3*b* is embodied as the smaller channel in terms of volume, meaning that the cross-sectional surface 17 of the hub-side channel 3*b* is smaller along the axis A than the cross-sectional surface 18 of the channel 3*a*. If the burner is operated with syngas, the channel 3*b* will have just this syngas applied to it. Because of the selected cross-sectional surface, the air 5 is thus largely expelled in the channel 3*b* and then mainly flows through the outer larger channel 3*a*. This largely gives rise to a diffusive syngas operation. Channel 3*a* has however compared to a conventional channel unaffected by separating means 15 a smaller cross-sectional surface 18 which is likewise advantageous for the operation of a syngas burner, since in a syngas burner the oxygen extracted from the air is used for syngas generation. For this purpose air is preferably extracted at the compressor.

In addition the very fuel-rich syngas/air mixture advantageously exits at roughly the same speed from the channel 3*b* as the air does from channel 3*a*. The result of this is that undesired shearings are avoided.

In normal gas operation, especially natural gas operation, the hub-side channel 3*b* has air applied to it and this can be premixed with fuel as for channel 3*a*.

Preferably the separating means 15 is placed on one of the flow lines (flow separating line). Compared to the conventional gas burner only minimal changes occur during operation with this type of placement. These can thus also be integrated into existing burners.

Figure 2:
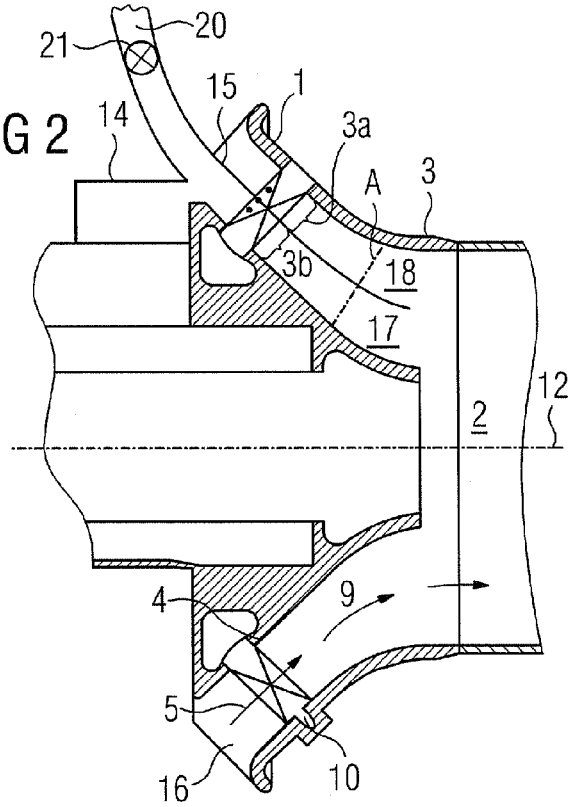
FIG. 2 a section through a part of a further exemplary embodiment of an inventive burner.

FIG. 2 now shows a further exemplary embodiment of an inventive burner 100. This has a line 20 upstream of channel 3*b*. This line 20 is a pipe for example. A flap or a regulation valve 21 can be located within the line 20. The upstream end of the line 20 is connected to the gas turbine such that an air mass flow 5 can also flow through it. The upstream end of the line 20 is thus for example connected to the plenum and/or to the compressor and/or to the compressor output so that this air mass flow 5 can flow through.

If the inventive burner of FIG. 2 is now operated with syngas, the flap or the valve 20 is closed so that no airflow 5 can flow through. The channel 3*b* thus has syngas applied to it on its own. The channel 3*a*, as also shown in FIG. 1, will continue to have an air mass flow 5 applied to it. The valve or the flap 20 can be controlled manually or control can be automated. If the inventive burner of FIG. 2 is now operated with natural gas for example, the flap/the valve 20 is opened. The air mass flow 5 thus also flows through the channel 3*b*. High calorific value fuel is injected via standard natural gas inlet openings. The burner thus corresponds once again to a standard natural gas premixing burner with low NOx values.

With this burner design there can thus be a controlled and very rapid switch between syngas and natural gas.

Inventively a channel provided with a separation means can thus be separated into at least two channels, with one of the two channels, preferably the smaller channel in terms of volume, being used as a syngas passage or as a second air passage. Advantageously such a separation means in natural gas operation has the same aerodynamics as in a conventional burner. The burner can thus simultaneously be operated in accordance with the invention as a syngas burner and as a natural gas (premixing) burner. Instead of natural gas, any other high-calorie fuel can be used, for example heating oil.

The inventive separation means thus disclose a burner which can exhibit low NOx values both in syngas operation and also in normal natural gas premixing operation.

The invention claimed is:

1. A burner, comprising:

a channel including a mixing zone;

an oxidation means supply;

a fuel supply for injection of fuel; and a separating means provided in the channel which divides the channel over a wide area of the channel into at least two separate coaxial channels respectively extending in a direction along a common flow line, said at least two coaxial channels comprising a first channel and a second channel, wherein an inlet opening is arranged for a first fuel, so that the first fuel is injected into the second channel, and further wherein an oxidation means is injected into the first channel during, and wherein a plurality of fuel nozzles for a further fuel are arranged downstream from the oxidation means supply and the inlet opening such that the separating means passes through the plurality of fuel nozzles and extends past the plurality of fuel nozzles towards the mixing zone so that the further fuel is injected into both the first channel and the second channel in order to be premixed in the mixing zone.

2. The burner as claimed in claim 1, further comprising a central axis, and wherein the separating means is concentric to the central axis.

3. The burner as claimed in claim 2, wherein the separating means is essentially arranged on the flow line.

4. The burner as claimed in claim 1, wherein the separating means comprises metal or a metal alloy.

5. The burner as claimed in claim 4, wherein the separating means is a metal sheet.

6. The burner as claimed in claim 1, further comprising a swirl generator including a plurality of swirler blades, and wherein the inlet opening is arranged upstream of the plurality of swirler blades in a main direction of flow.

7. The burner as claimed in claim 1, wherein the plurality of fuel nozzles are arranged in one or more rows lying behind one another downstream of the swirl generator.

8. The burner as claimed in claim 1, wherein the plurality of fuel nozzles are located in the swirl generator.

9. The burner as claimed in claim 1, wherein the second channel includes a smaller volume than that of the first channel.

10. The burner as claimed in claim 1, wherein a line is included upstream of and connected to the second channel.

11. The burner as claimed in claim 10, wherein the line includes a valve and/or a flap.

12. The burner as claimed in claim 1, wherein the first fuel is syngas.

13. A gas turbine, comprising:

a burner, comprising:

a channel including a mixing zone;

an oxidation means supply;

a fuel supply for injection of fuel; and a separating means provided in the channel which divides the channel over a wide area of the channel into at least two separate coaxial channels respectively extending in a direction along a common flow line, said at least two coaxial channels comprising a first channel and a second channel, wherein an inlet opening is arranged for a first fuel, so that the first fuel is injected into the second channel, and further wherein an oxidation means is injected into the first channel during, and wherein a plurality of fuel nozzles for a further fuel are arranged downstream from the oxidation means supply and the inlet opening such that the separating means passes through the plurality of fuel nozzles and extends past the plurality of fuel nozzles towards the mixing zone so that the further fuel is injected into both the first channel and the second channel in order to be premixed in the mixing zone.

14. The gas turbine as claimed in claim 13, further comprising a central axis, and wherein the separating means is concentric to the central axis, wherein the separating means is essentially arranged on the flow line, and wherein the separating means comprises metal or a metal alloy.

15. The gas turbine as claimed in claim 13, further comprising a swirl generator including a plurality of swirler blades, and wherein the inlet opening is arranged upstream of the plurality of swirler blades in a main direction of flow.

16. A method for operating a burner, comprising:

applying a syngas to a second channel and an oxidation means to a first channel in the burner in synthetic gas operation; or applying natural gas and an oxidation means to the first channel and the second channel in natural gas operation, wherein the burner, comprises:

a channel including a mixing zone;

an oxidation means supply;

a fuel supply for injection of fuel; and a separating means provided in the channel which divides the channel over a wide area of the channel into at least two separate coaxial channels respectively extending in a direction along a common flow line, said at least two coaxial channels comprising a first channel and a second channel, and wherein an inlet opening is arranged for a fuel, so that the syngas is injected into the second channel during synthetic gas operation, or wherein a plurality of fuel nozzles for the natural gas are arranged downstream from the oxidation means supply and the inlet opening such that the separating means passes through the plurality of fuel nozzles and extends past the plurality of fuel nozzles towards the mixing zone so that the natural gas is injected into both the first channel and the second channel in order to be premixed in the mixing zone during the natural gas operation.

17. The method as claimed in claim 16, wherein the oxidation means is air.

18. The method as claimed in claim 16, wherein the mixing zone further comprises a cone side a hub side and a swirl generator, and wherein the fuel is injected on the the hub side via the swirl generator into the mixing zone.

19. The method as claimed in claim 18, wherein the fuel is injected via a swirler blade of the swirl generator into the mixing zone.

* * * * *